US012653279B2

(12) United States Patent
Jaccard et al.

(10) Patent No.: US 12,653,279 B2
(45) Date of Patent: Jun. 16, 2026

(54) THERMAL COMPENSATION SYSTEM FOR FLUIDIC DECORATION CAPSULE

(71) Applicant: Preciflex SA, Neuchâtel (CH)

(72) Inventors: Alain Jaccard, Ste-Croix (CH); Johann Rohner, Pomy (CH); Toralf Bork, Enges (CH)

(73) Assignee: Precitlex SA, Neuchâtel (CH)

( * ) Notice: Subject to any disclaimer, the term of this patent is extended or adjusted under 35 U.S.C. 154(b) by 210 days.

(21) Appl. No.: 17/622,722

(22) PCT Filed: Jun. 5, 2020

(86) PCT No.: PCT/IB2020/055313

§ 371 (c)(1),
(2) Date: Dec. 24, 2021

(87) PCT Pub. No.: WO2020/245786

PCT Pub. Date: Dec. 10, 2020

(65) Prior Publication Data

US 2022/0248816 A1 Aug. 11, 2022

Related U.S. Application Data

(60) Provisional application No. 62/857,317, filed on Jun. 5, 2019.

(51) Int. Cl.
*A44C 25/00* (2006.01)
*A44C 15/00* (2006.01)

(52) U.S. Cl.
CPC ..... *A44C 25/00* (2013.01); *A44C 15/00* (2013.01)

(58) Field of Classification Search
CPC ... A44C 25/00; A44C 17/0241; A44C 17/025; A44C 17/0275; A44C 17/0283; A44C 17/0291; A44C 17/02; A44C 15/00; G04B 45/0023; G04B 45/00
See application file for complete search history.

(56) References Cited

U.S. PATENT DOCUMENTS

| | | | | |
|---|---|---|---|---|
| 3,486,108 | A | 12/1969 | Schmidt | |
| 4,080,781 | A * | 3/1978 | Klingenberg | G04B 37/02 368/286 |
| 6,188,526 | B1 | 2/2001 | Sasaya et al. | |
| 11,317,686 | B2 * | 5/2022 | Vouillamoz | A44C 5/0007 |
| 2007/0234757 | A1 * | 10/2007 | Sherman | A44C 25/002 63/18 |
| 2008/0173045 | A1 * | 7/2008 | Turner | A44C 25/002 40/406 |

(Continued)

FOREIGN PATENT DOCUMENTS

| | | | |
|---|---|---|---|
| CN | 102466828 | A | 5/2012 |
| CN | 108348062 | A | 7/2018 |
| FR | 2882829 | A1 | 9/2006 |

(Continued)

*Primary Examiner* — Jack W Lavinder
(74) *Attorney, Agent, or Firm* — Da Vinci Partners LLC; John Brent Moetteli

(57) ABSTRACT

A system comprising at least one liquid, the system able to accommodate the thermal expansion/compression of such liquid over a given temperature range without leaking, bursting, and without the generation of bubbles, by adapting its liquid containing chamber volume to the ambient temperature.

11 Claims, 9 Drawing Sheets

(56) References Cited

U.S. PATENT DOCUMENTS

| | | | | |
|---|---|---|---|---|
| 2012/0155230 | A1 | 6/2012 | Patt | |
| 2019/0216185 | A1* | 7/2019 | Carpano ..... | A44C 25/002 |

FOREIGN PATENT DOCUMENTS

| | | | |
|---|---|---|---|
| JP | H01111869 | U | 7/1989 |
| JP | H02111889 | U | 9/1990 |
| JP | 2000081503 | A | 3/2000 |
| JP | 2011510337 | A | 3/2011 |
| JP | 2012098718 | A | 6/2012 |
| JP | 2012128414 | A | 7/2012 |
| JP | 2017138189 | A | 7/2017 |
| JP | 2018513375 | A | 5/2018 |
| WO | 2004021369 | A2 | 3/2004 |
| WO | 2015150910 | A2 | 10/2015 |
| WO | 2018162745 | A1 | 10/2016 |
| WO | 2017060767 | A1 | 4/2017 |
| WO | 2018065445 | A1 | 3/2018 |
| WO | 2018016697 | A1 | 1/2019 |

* cited by examiner

THERMAL COMPENSATION SYSTEM FOR FLUIDIC DECORATION CAPSULE

CROSS REFERENCE TO RELATED APPLICATIONS

This application is the National Stage of International Application No. PCT/IB2020/055313, filed Jun. 5, 2020, which claims benefit under 35 USC § 119(a), to U.S. provisional patent application Ser. No. 62/857,317, filed Jun. 5, 2019.

COPYRIGHT & LEGAL NOTICE

A portion of the disclosure of this patent document contains material which is subject to copyright protection. The Applicant has no objection to the facsimile reproduction by anyone of the patent document or the patent disclosure as it appears in the Patent and Trademark Office patent file or records, but otherwise reserves all copyright rights whatsoever. Further, no references to third party patents or articles made herein is to be construed as an admission that the present invention is not entitled to antedate such material by virtue of prior invention.

BACKGROUND OF THE INVENTION

The invention relates to wearable accessories such as jewelry, watches, apparel. Most accessories are objects with a permanent shape and adornment. However, jewelry, watches, and apparel (also known as an accessory or accessories) exists that includes an element that moves, thereby providing an animation effect, when moved. Some exist wherein the decorative element is suspended in a fluid. However, such prior art devices dealt with thermal expansion by providing a bubble in a liquid. A bubble is a sign of poor quality or a leak, and so is undesirable, even unsightly to a user or wears.

What is needed is a system/apparatus and/or method that compensates for thermal variations without a visible bubble.

What is needed is a system/apparatus and/or method that allows the creation of accessories and/or fashion items containing fluidic animations while ensuring the integrity of the fluidic animation over a given range of temperatures.

What is needed is a system/apparatus and/or method that does not generate leaks or breakages in case of nominal temperature increase.

What is needed is a system/apparatus and/or method that avoids the appearance of unsightly gas bubbles in case of temperature decrease.

What is needed is a new way to make accessories more alive by allowing their appearance to change, using liquid animations.

SUMMARY OF THE INVENTION

A system, apparatus and method is provided which provides means to create an apparently living decoration for personal accessories. The system is made up of a capsule containing at least one liquid in which decorative elements are allowed to move to provide an animation. Generally the thermal expansion/compression rate of liquids is significantly higher than the thermal expansion/compression rate of solids. The system provides the ability to completely fill the visible part of the capsule with liquid while avoiding undesirable and unsightly gas bubbles and/or system degradation or destruction when the ambient temperature changes.

BRIEF DESCRIPTION OF THE DRAWINGS

The attached drawings represent, by way of example, different embodiments of the subject of the invention.

Those skilled in the art will appreciate that elements in the Figures are illustrated for simplicity and clarity and have not necessarily been drawn to scale. For example, dimensions may be exaggerated relative to other elements to help improve understanding of the invention and its embodiments. Furthermore, when the terms 'first', 'second', and the like are used herein, their use is intended for distinguishing between similar elements and not necessarily for describing a sequential or chronological order. Moreover, relative terms like 'front', 'back', 'top' and 'bottom', and the like in the Description and/or in the claims are not necessarily used for describing exclusive relative position. Those skilled in the art will therefore understand that such terms may be interchangeable with other terms, and that the embodiments described herein are capable of operating in other orientations than those explicitly illustrated or otherwise described.

DETAILED DESCRIPTION OF THE PREFERRED EMBODIMENT

The following description is not intended to limit the scope of the invention in any way as it is exemplary in nature, serving to describe the best mode of the invention known to the inventors as of the filing date hereof. Consequently, changes may be made in the arrangement and/or function of any of the elements described in the exemplary embodiments disclosed herein without departing from the spirit and scope of the invention.

The system according to this invention includes at least one fluidic capsule containing at least one liquid and is destined to be worn by a wearer/user as an accessory, an item of jewelry, a wristwatch, or any other fashion item.

Figure 1A:
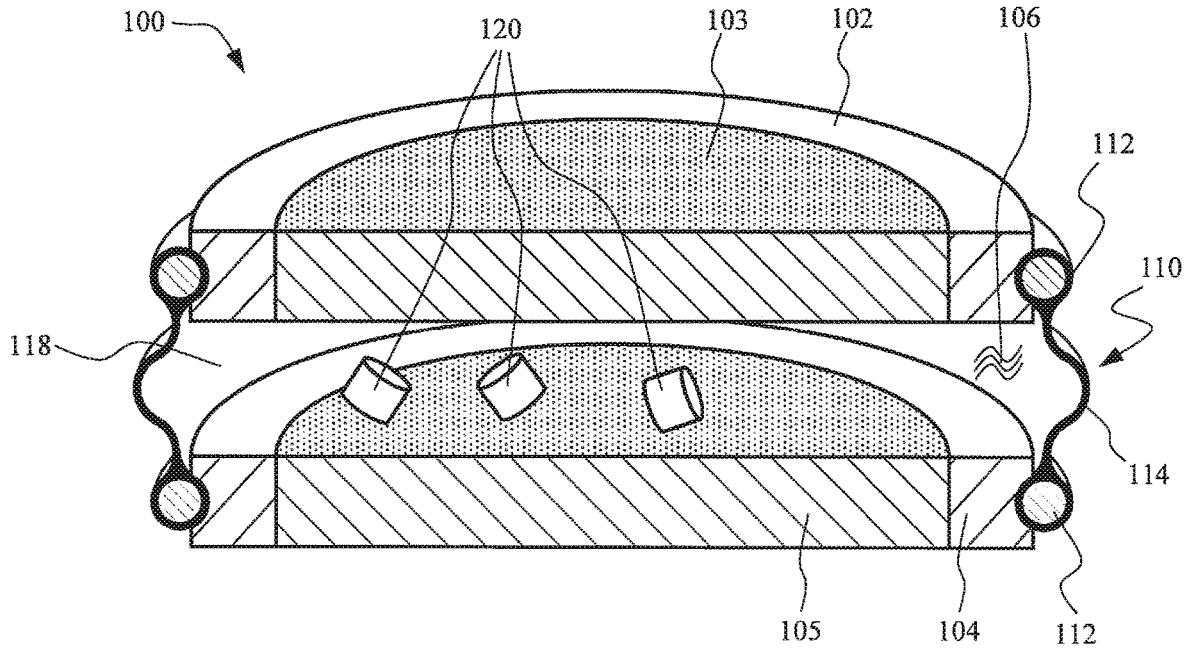
FIG. 1A is a cross-sectional side view of an embodiment of the invention.
Figure 1B:
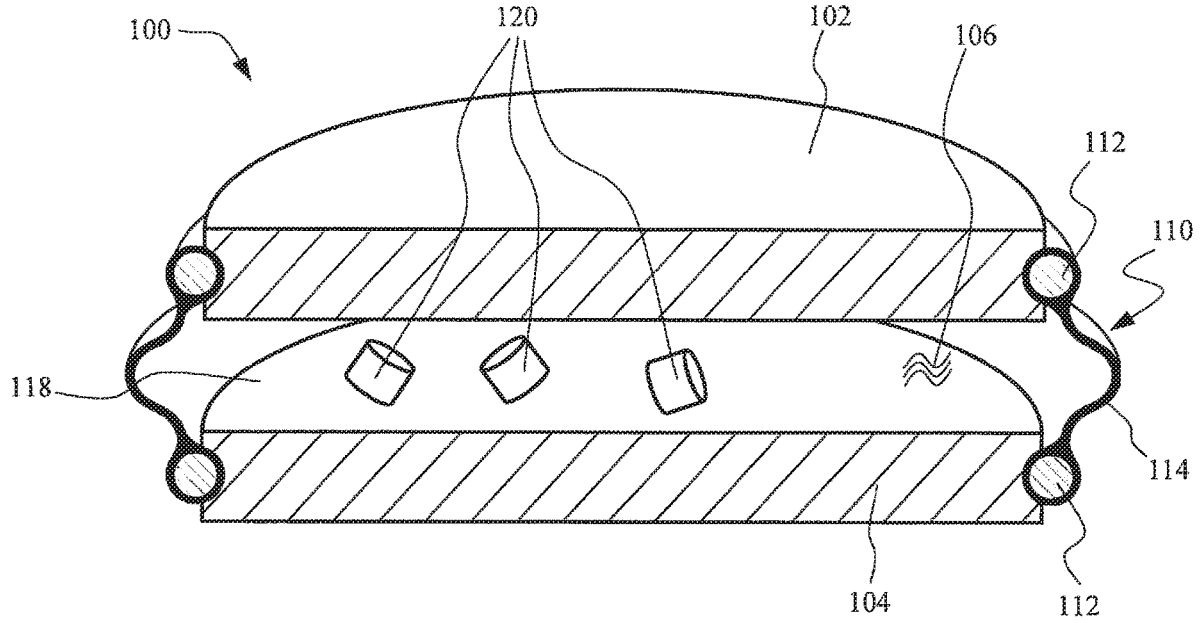
FIG. 1B is a cross-sectional side view of the embodiment of FIG. 1A at a lower temperature, where the top plate and bottom plate of the capsule are free to move relative to each other.
Figure 1C:
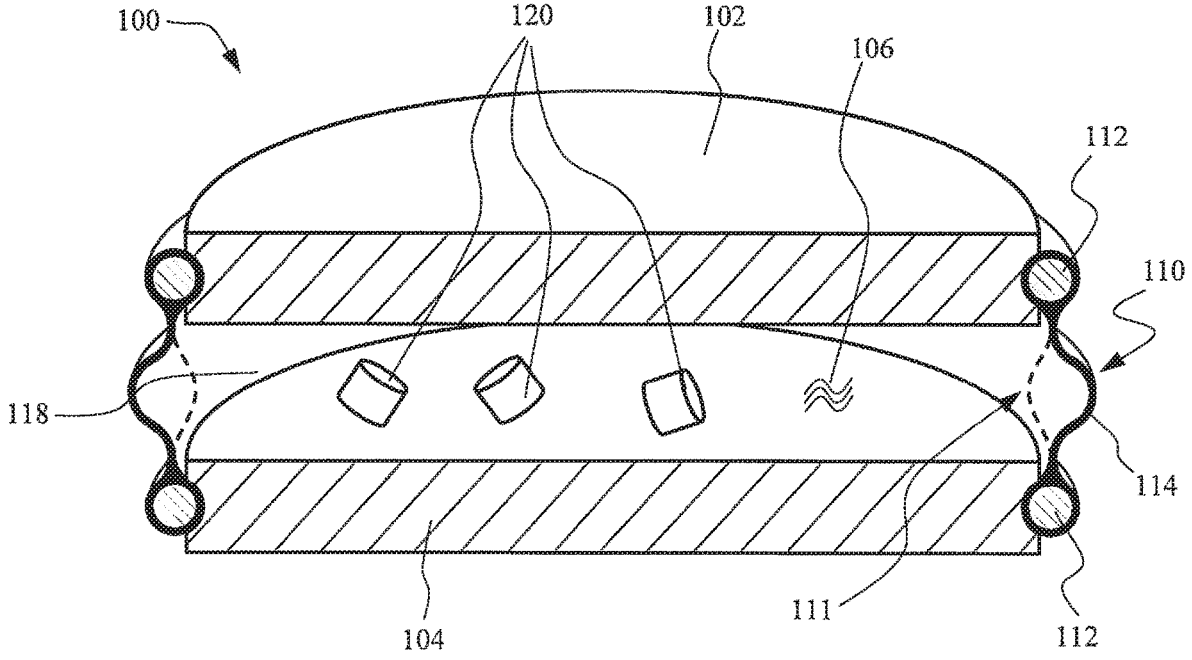
FIG. 1C is a cross-sectional side view of the embodiment of FIG. 1A at a higher and a lower temperature, where the top plate and bottom plate of the capsule are fixed relative to each other.
Figure 2A:
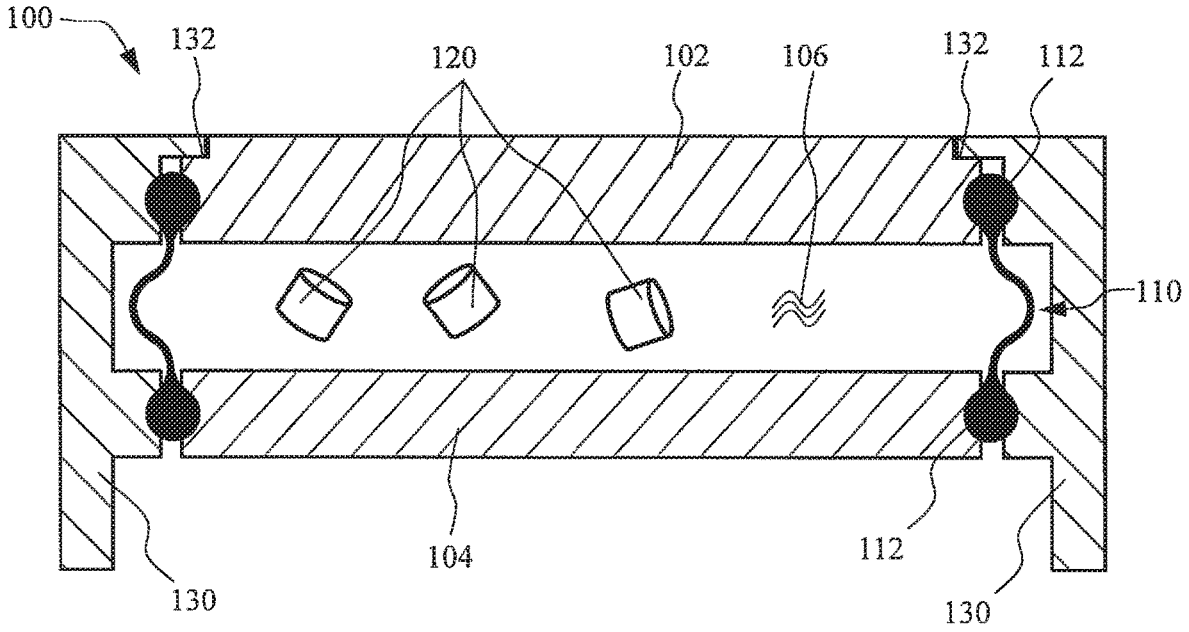
FIG. 2A is a cross-sectional side view of a second embodiment at a higher temperature, when the top plate and bottom plate of the capsule are fixed relative to each other via an external structure.
Figure 2B:
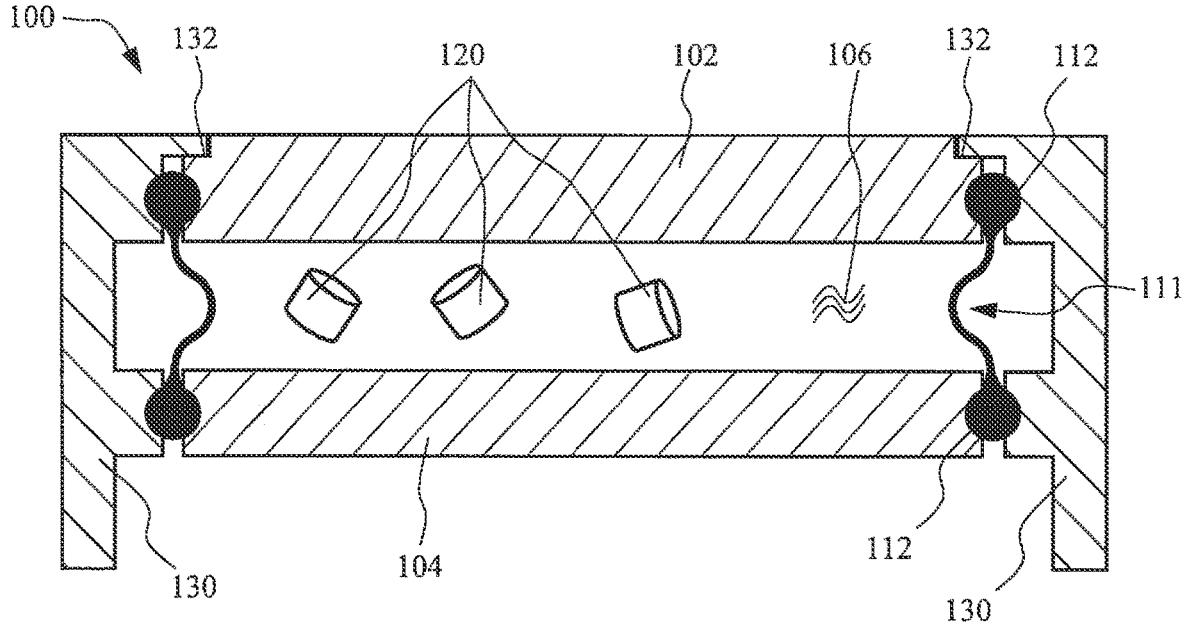
FIG. 2B is a cross-sectional view of the embodiment of FIG. 2A at a lower temperature.

Referring now to FIGS. 1A-C, the fluidic capsule 100 consists of a top plate 102 attached to a bottom plate 104 by a semi-flexible wall 114, and contains at least one liquid 106. Even though the figures may show the top plate 102 having the same diameter as the bottom plate 104, the fluidic capsule 100 may also be constructed with the top plate 102 of a different diameter from the bottom plate 104. For example, the semi-flexible wall 114 may have a global conical shape instead of cylindrical. The liquid 106 is chosen to exhibit specific properties of viscosity, density, thermal expansion index, color, transparency, or light refraction index, etc. The capsule may also contain decorative elements 120 or structures (not shown) able to generate a visual animation actuated by gravity when the user/wearer changes the orientation of the fluidic capsule relative to a gravitational force, by an acceleration provided by the movement of the user/wearer, or by a manual or automatic actuation mechanism, such as described in US Provisional Application U.S. 62/835,038 filed Apr. 17, 2019 or in PCT/IB2019/058381 filed Oct. 2, 2019, the contents of which are incorporated by reference herein, contained in the accessory, item of jewelry, wristwatch, or any other fashion item where the fluidic capsule 100 is integrated. This feature of comprising decorative elements 120 may not be expressly shown in any of the other embodiments disclosed in the instant description. Nevertheless, this feature is or may be comprised in any of the embodiments shown in FIGS. 1A-1C, FIGS. 2A-B, FIGS. 3A-B, FIG. 4, FIGS. 5A-B and FIGS. 6 to 9 as disclosed in the instant description. The decorative elements 120 or structures (not shown) may be chosen so that at least a part of at least one of the decorative elements exhibits specific properties of density, visible light properties such as transparency, color, reflectivity, filtration capabilities, and/or refraction index. The refraction index of the fluid 106 and the refraction index of at least one portion of the decorative elements 120 may be chosen to be substantially identical, such as less than 10% different, preferably less than 5%, ideally less than 3% different than the liquid 106, so that any selected part of the decorative elements can be made invisible for the user/observer/wearer. The decorative elements 120 may be actuated by gravity when the user/wearer changes the orientation of the fluidic capsule 100 relative to a gravitational force, by an acceleration provided by the movement of the capsule by the user/wearer, or by activating a manual or automatic actuation mechanism, such as described in US Provisional Application U.S. 62/835,038 filed Apr. 17, 2019, for example, on page 4, lines 12 to 17 or in PCT/IB2019/058381 filed Oct. 2, 2019, for example, on page 5, lines 19 to 22. FIG. 1A shows the fluidic capsule 100 at a given temperature while FIG. 1B shows the same fluidic capsule 100 at a lower temperature, where the top plate 102 and the bottom plate 104 are free to move relative to each other, and where the contraction of the capsule 100 is evident. Generally, the thermal expansion/compression rate of liquids is significantly higher than the thermal expansion/compression rate of solids. As the top plate 102 and the bottom plate 104 have nearly no thermal compression compared to the compression of the at least one liquid 106, the volume difference due to the thermal compression of the at least one liquid 106 is compensated for by a deformation of the semi-flexible wall 114, so that the fluidic capsule 100 remains full of liquid, without the creation of undesirable or unsightly gas bubbles in the at least one liquid 106.

Referring now to FIG. 1C, the behavior of the semi-flexible wall 114 is shown when the top plate 102 and bottom plate 104 are fixed relative to each other and the temperature varies. In such case, at a higher temperature, the semi-flexible wall is extended towards the exterior of the fluidic capsule as shown by arrow 110, and when the temperature decreases, the semi-flexible wall retracts towards the inside of the fluidic capsule, such as indicated by arrow 111. Of course, a combination of relative movement of the top plate 102 and the bottom plate 104 and flexion of the semi-flexible wall 114 towards the inside or outside of the fluidic capsule may be used to enhance the capacity/volume 118 of the fluidic capsule 100 to adapt to ambient temperature variations while avoiding undesirable and unsightly gas bubbles and/or system degradation or destruction. Relative freedom of movement between top plate 102 and bottom plate 104 may also be used to facilitate the buckling of the semi-flexible wall 114. The semi-flexible wall 114 can be made of a polymer, a composite, an organic material, or a metal, or any combination thereof, and it can be the accessory's casing itself where areas to which components are affixed are simply reinforced with additional material, the material where flexing is to occur being made thinner. The inflection point (or plane) near where the arrowhead to element 110 in FIG. 1A is located can be sharp and not rounded, and extend outwardly much further than shown in the drawing. It may as well extend inwardly. The top plate 102 may be made of a single material or an assembly of different materials, and it may have at least one transparent portion 103 through which the user/wearer can see inside the capsule. This feature of comprising top plate may be made of a single material or an assembly of different materials, and it may have at least one transparent portion through which the user/wearer can see inside the capsule may not be expressly shown in any of the other embodiments disclosed in the instant description. Nevertheless, this feature is or may be comprised in any of the embodiments shown in FIGS. 1A-1C, FIGS. 2A-B, FIGS. 3A-B, FIG. 4, FIGS. 5A-B and FIGS. 6 to 9 as disclosed in the instant description. Typical materials for the top plate 102 include sapphire, glass, transparent plastics, etc. The top plate 102 may present additional geometrical features (shown exemplarly in FIGS. 2A and 2B by reference no. 132) allowing the capsule to be attached in an accessory's structure (shown exemplarly in FIGS. 2A and 2B by reference no. 130) as well known in the industry. The bottom plate 104 may be made of a single material or an assembly of different materials, and may be opaque or may have at least one transparent portion 105 through which the user/wearer can see through the capsule. This feature of comprising the bottom plate may be made of a single material or an assembly of different materials, and may be opaque or may have at least one transparent portion 105 through which the user/wearer can see through the capsule may not be expressly shown in any of the other embodiments disclosed in the instant description. Nevertheless, this feature is or may be comprised in any of the embodiments shown in FIGS. 1A-1C. FIGS. 2A-B, FIGS. 3A-B, FIG. 4, FIGS. 5A-B and FIGS. 6 to 9 as disclosed in the instant description. In one embodiment (shown in FIGS. 1A-1C), the semi-flexible wall 114 is made of a semi-flexible ribbon formed as a closed loop to enable closing of the capsule 100. The semi-flexible wall 114 may essentially be made of polymer, rubber, metal, or any other flexible material and may contain structures 112 made of rigid or semi-rigid materials such as a ring, a metallic cable, glass fibers, carbon fibers, etc. and preferably is overmolded. The semi-flexible wall may have pre-shaped bends to ensure that the top plate 102 and the bottom plate 104 remain substantially parallel, independent of the volume 118 of the at least one liquid 106 contained in the capsule 100. The semi-flexible wall 114 may be surface treated in order to improve its liquid-tightness and/or its resistance to temperatures, to ultraviolet radiation, etc. The top plate 102 and the bottom plate 104 have at least one feature in which the structures 112 of the semi-flexible wall 114 can be fixed, so that the assembly is liquid-tight. For example, the top plate 102 and the bottom plate 104 have at least one groove in which the structures 112 of the semi-flexible wall 114 can snap, so that the assembly is liquid-tight.

In another embodiment (shown in FIGS. 2A-2B), the structures 112 are made of a thicker zone of the semi-flexible wall 114, and held in place squeezed between the top plate 102 and the accessory's structure 130, respectively between the bottom plate 104 and the accessory's structure 130, similarly to the installation of an O-ring as well known in the industry. Further sealing processes like gluing may be applied after assembly. Such assembly may take place immersed in the at least one liquid 106 so that no air bubble remains inside the capsule 100. At assembly, the ambient temperature must be taken into account to not overfill the capsule 100, allowing a temperature range in which the semi-flexible wall 114 can extend to accommodate the thermal expansion of the at least one liquid 106. Conversely, when the temperature decreases, the semi-flexible wall may bend to decrease the internal volume of the capsule, avoiding the creation of depression which may trigger the appearance of gas bubbles in the at least one liquid 106.

Figure 3A:
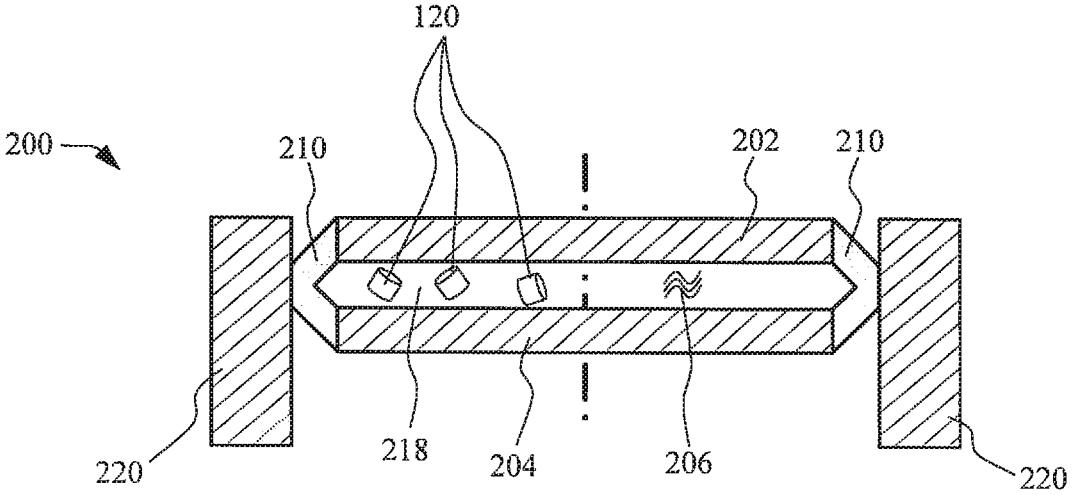
FIG. 3A is a cross-sectional side view of a third embodiment of the invention.
Figure 3B:
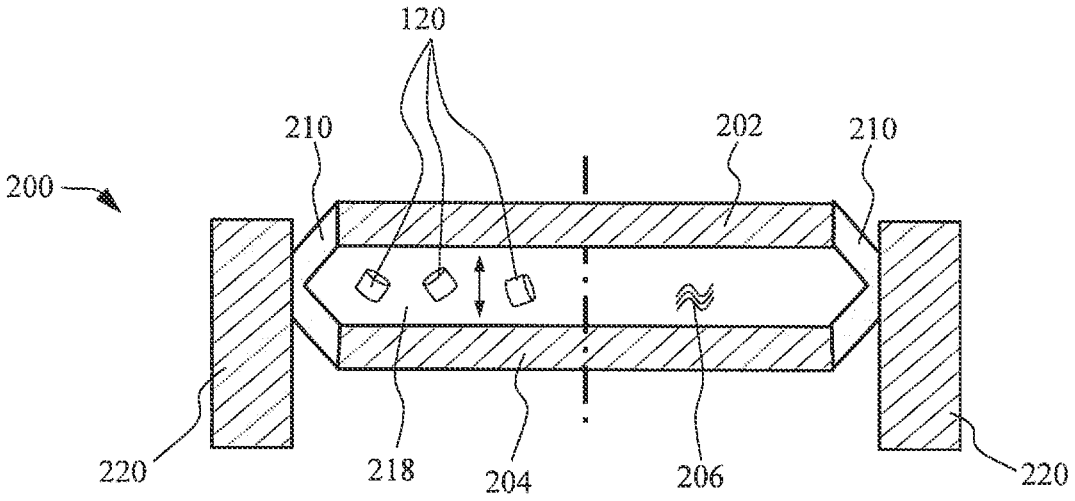
FIG. 3B is a cross-sectional side view of the embodiment of FIG. 3A at a higher temperature.

Referring now to FIGS. 3A-3B, the fluidic capsule 200 includes a top plate 202 attached to a bottom plate 204 through a gasket 210, and contains at least one liquid 206. The gasket 210 is attached to the accessory's structure 220. The thermal expansion/compression rate of the gasket is significantly higher than the thermal expansion/compression rate of solids such as the top plate 202, the bottom plate 204 or the structure 220. As shown in FIG. 3B vs FIG. 3A, an increase of ambient temperature generates an expansion of the gasket 210 which increases the internal volume 218 of the capsule 200, allowing the thermal expansion of the at least one liquid 206 without damaging the integrity of the capsule 200.

Figure 4:
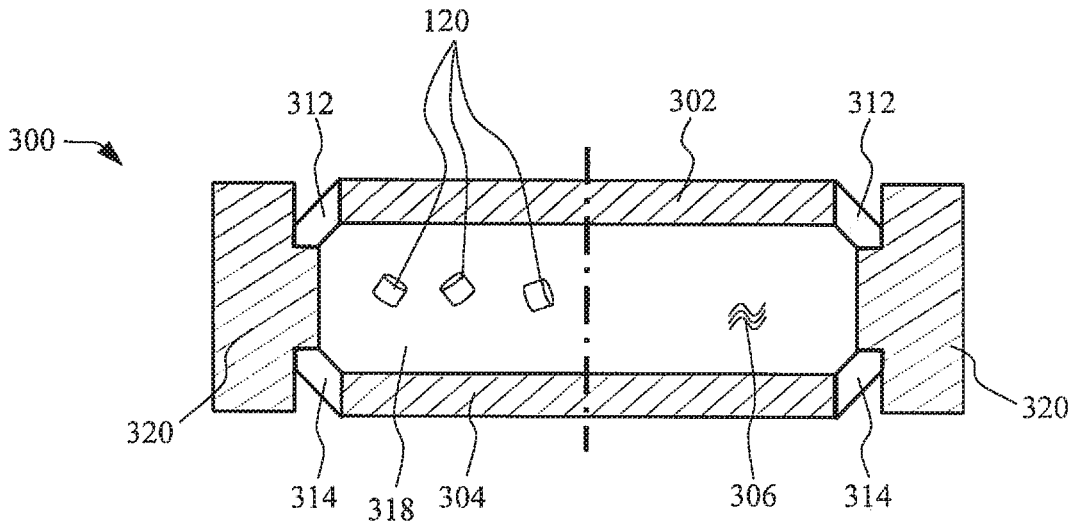
FIG. 4 is a cross-sectional side view of a fourth embodiment of the invention.

Referring now to FIG. 4, the fluidic capsule 300 includes a top plate 302 attached to the accessory structure 320 by a top gasket 312 and a bottom plate 304 attached to the accessory structure 320 by a bottom gasket 314, and contains at least one liquid 306. The thermal expansion/compression rate of the gaskets 312 and 314 is significantly higher than the thermal expansion/compression rate of solids such as the top plate 302, the bottom plate 304 or the structure 320. An increase of ambient temperature generates an expansion of the gaskets 312 and 314 which increases the internal volume 318 of the capsule 300, allowing the thermal expansion of the at least one liquid 306 without damaging the integrity of the fluidic capsule 300. In one embodiment, one of the plates 302 or 304 may be fixed to the structure 320. The expansion of the inner chamber takes place then in only one direction.

Figure 5A:
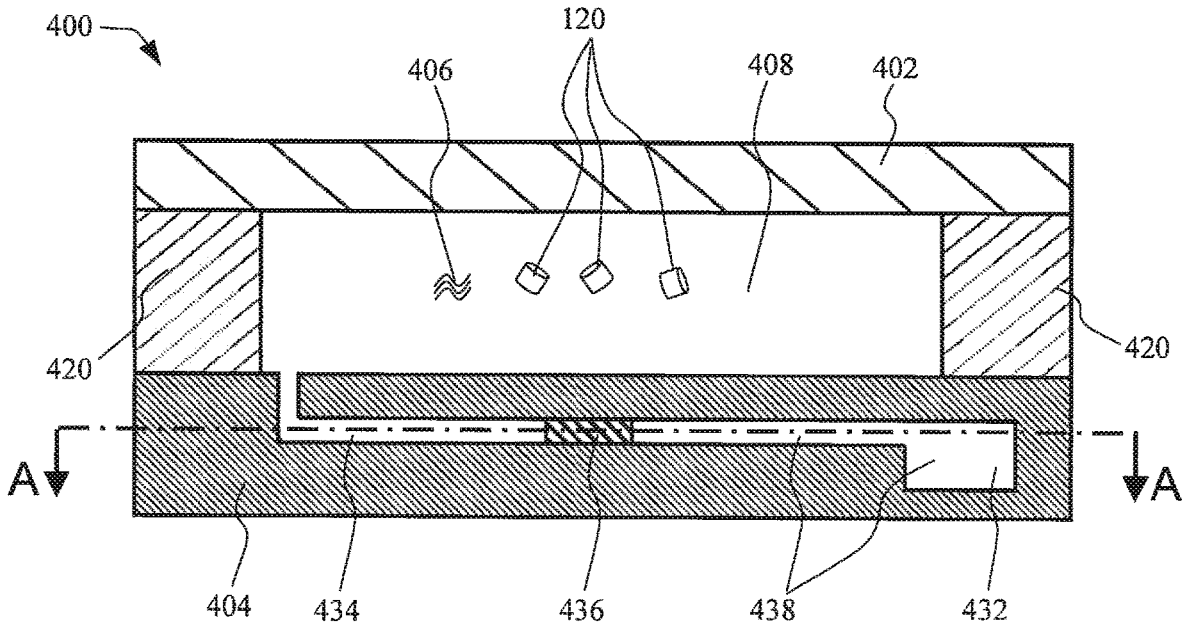
FIG. 5A is a cross-sectional side view taken along line B-B of FIG. 5B. of a fifth embodiment of the invention
Figure 5B:
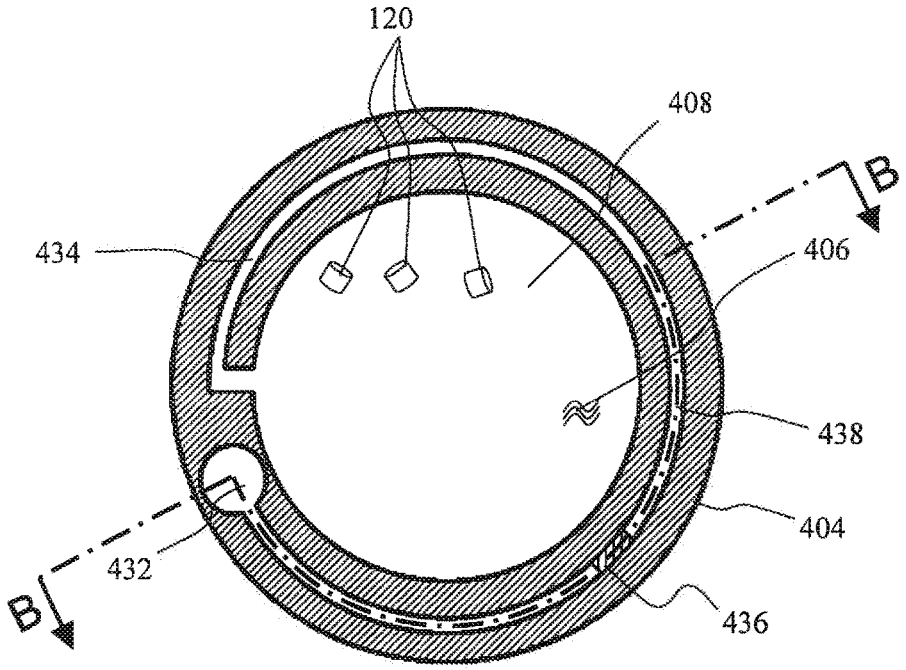
FIG. 5B is a cross-sectional top view taken along line A-A of FIG. 5A. of the fifth embodiment of the invention

Referring now to FIGS. 5A-5B, the fluidic capsule 400 includes a top plate 402 attached to a bottom plate 404 by a rigid structure 420, forming a rigid main chamber 408 and contains at least one liquid 406. The bottom plate 404 contains an expansion chamber 432 filled with gas 438 and connected to the rigid main chamber 408 via a small channel 434. The dimensions of the channel 434 are defined so that the capillarity forces create a meniscus between the at least one liquid 406 and the gas 438. In order to prevent the gas 438 from dissolving in the at least one liquid 406 or the at least one liquid 406 from evaporation in the gas 438, an additional liquid 436 separates the gas 438 from the at least one liquid 406. The additional liquid 436 is non-miscible with the at least one liquid 406, and doesn't absorb gas 438 so that gas 438 cannot pass the barrier constituted by the additional liquid 436. A functionality similar to that of the additional liquid 436 may also be realized using a gel 436' with the same properties of non-miscibility with the at least one liquid 406 and non-absorption of gas 438, or even with a mobile solid plug 436" or piston. When the system is subjected to temperature variation, for example a temperature increase, the liquid 406 expands, reducing the volume of the gas 438. The length of the channel 434 is defined so that the meniscus between the at least one liquid 406 and the gas 438, and in the case of an additional liquid 436 between the two liquids, remains inside the channel over a defined temperature range. The channel 434 may be surface treated in order to help the displacement of the meniscus. As shown in FIG. 5B, the channel 434 can be installed in the periphery of the bottom plate 404 in the event that the bottom plate is transparent and the channel needs to be out of the view of an observer looking through the fluidic capsule 400, or even in the structure 420.

Figure 6:
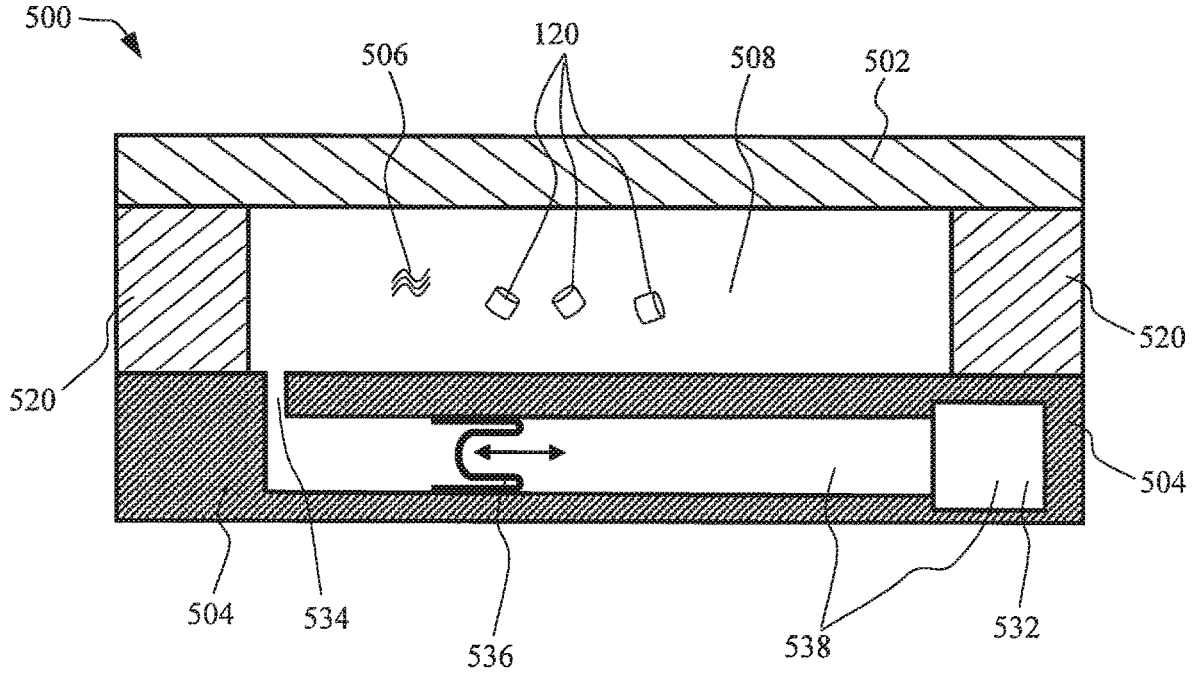
FIG. 6 is a cross-sectional side view of a sixth embodiment of the invention.

Referring now to FIG. 6, the fluidic capsule 500 includes a top plate 502 attached to a bottom plate 504 by a rigid structure 520, forming a rigid main chamber 508 and contains at least one liquid 506. The bottom plate 504 contains an expansion chamber 532 filled with gas 538 and is connected to the rigid main chamber 508 via a channel 534. A rolling membrane 536 creates the separation between the at least one liquid 506 and the gas 538. When the at least one liquid 506 expands or contracts due to variation of temperature, the rolling membrane 536 rolls or unrolls to adapt to the volume variation of the at least one liquid 506. An additional guiding slider (not represented) may be used to ensure a correct displacement of the rolling membrane.

Figure 7:
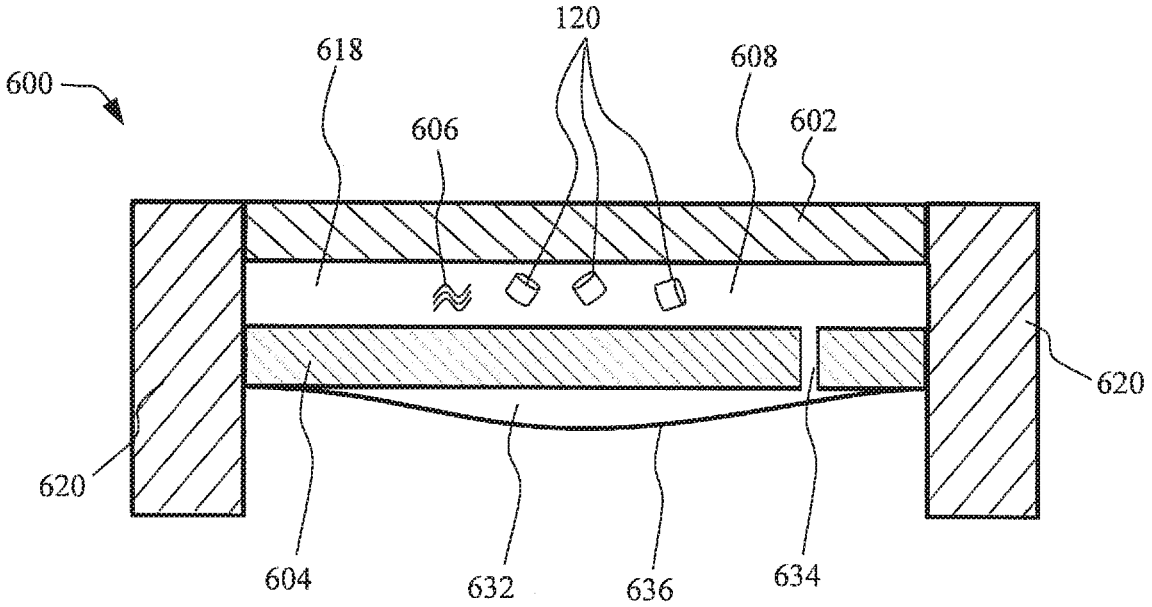
FIG. 7 is a cross-sectional side view of a seventh embodiment of the invention.
Figure 8:
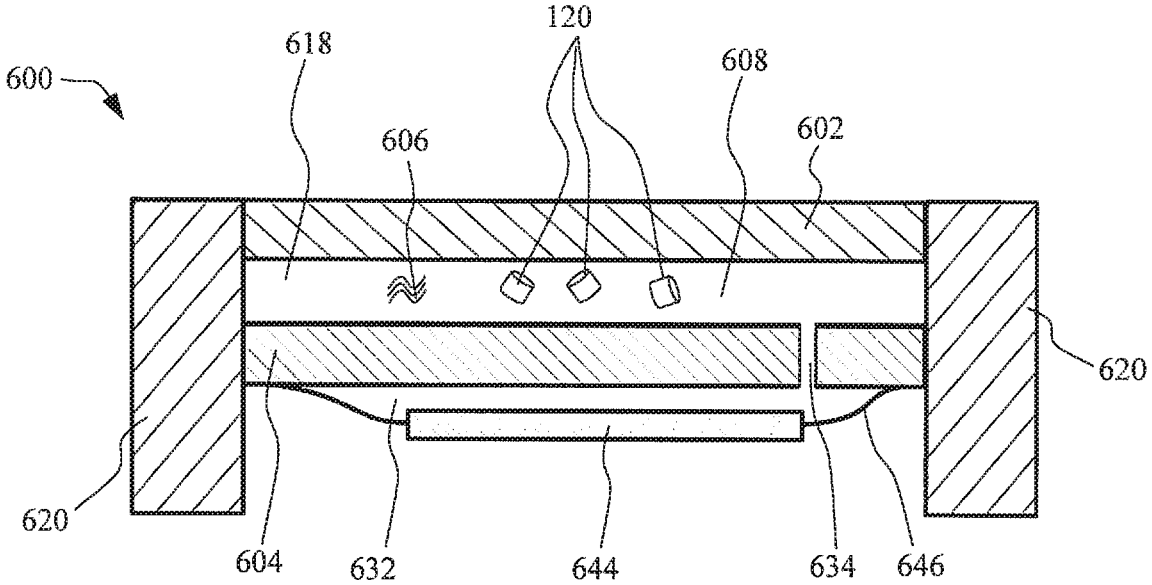
FIG. 8 is a cross-sectional side view of an eighth embodiment of the invention.

Referring now to the embodiments shown in FIGS. 7 and 8, the fluidic capsule 600 includes a top plate 602 attached to a bottom plate 604 by a rigid structure 620, forming a rigid main chamber 608 and containing at least one liquid 606. The bottom plate 604 contains a channel 634 connecting to a flexible expansion chamber 632 formed by a membrane 636, so that the volume 618 of the fluidic capsule can adapt to the thermal expansion of the fluid 606 as the ambient temperature changes. Alternatively, the membrane 636 may also be built in the form of a combination of rigid parts 644 and flexible parts 646.

Figure 9:
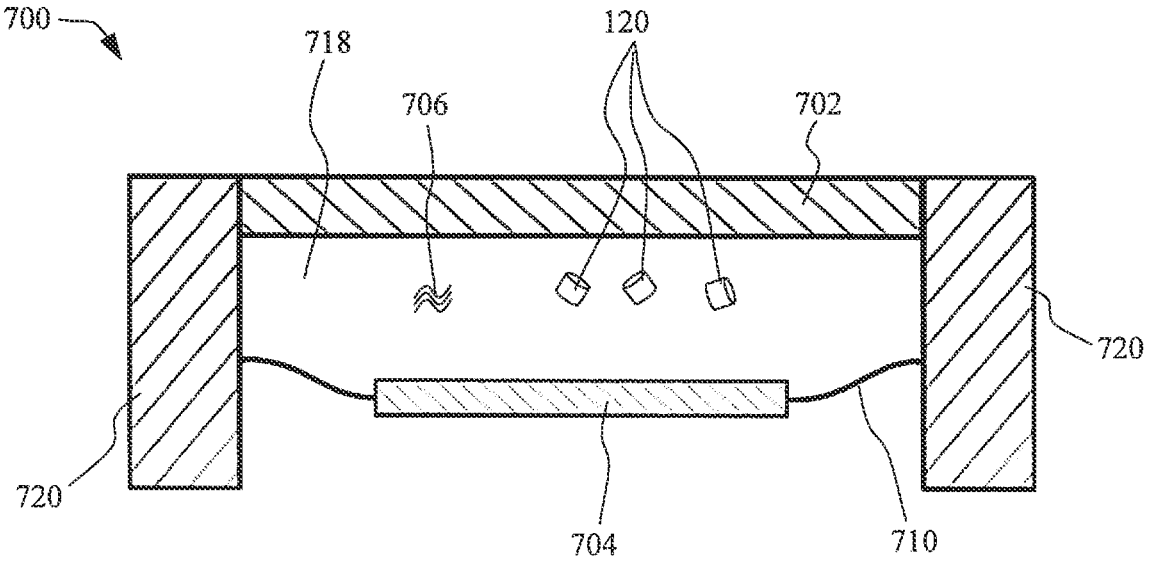
FIG. 9 is a cross-sectional side view of a ninth embodiment of the invention.

Referring now to FIG. 9, the fluidic capsule 700 includes a top plate 702 attached to a rigid structure 720, and a bottom plate 704 attached to the rigid structure 720 via a flexible membrane 710, and contains at least one liquid 706. The flexible membrane 710 allows for movement of the bottom plate 704 relative to the top plate 702, so that the volume 718 of the fluidic capsule can adapt following the thermal expansion of the fluid 706 as the ambient temperature changes.

The fluidic capsule may be used for other purposes than in decorative accessories. It may also be used for the storage and transport of fluid(s) in other personal accessories in order to avoid any leakage or breakdown when the ambient temperature varies, for example such as inhalors, e-vaping devices, perfume diffusers, and the like and in such case the capsule may not contain any transparent part.

In an advantage, the system and method/apparatus of the present invention allows the creation of accessories and/or fashion items containing fluidic animations and ensuring the integrity of the fluidic animation over a given range of temperatures.

In another advantage, the system/apparatus and/or method of the present invention does not generate leaks or breakages in case of nominal temperature increase.

In another advantage, the system/apparatus and/or method of the present invention avoids the appearance of unsightly gas bubbles in case of temperature decrease.

It should be appreciated that the particular implementations shown and herein described are representative of the invention and its best mode and are not intended to limit the scope of the present invention in any way.

Moreover, the system contemplates the use, sale and/or distribution of any goods, services or information having similar functionality described herein.

The specification and figures should be considered in an illustrative manner, rather than a restrictive manner, and all modifications described herein are intended to be included within the scope of the invention claimed. Accordingly, the scope of the invention should be determined by the appended claims (as they currently exist or as later amended or added, and their legal equivalents) rather than by merely the examples described above. Steps recited in any method or process claims, unless otherwise expressly stated, may be executed in any order and are not limited to the specific order presented in any claim. Further, the elements and/or components recited in apparatus claims may be assembled or otherwise functionally configured in a variety of permutations to produce substantially the same result as the present invention. Consequently, the invention should not be interpreted as being limited to the specific configuration recited in the claims.

Benefits, other advantages and solutions mentioned herein are not to be construed as critical, required or essential features or components of any or all the claims.

As used herein, the terms "comprises", "comprising", or variations thereof, are intended to refer to a non-exclusive listing of elements, such that any apparatus, process, method, article, or composition of the invention that comprises a list of elements, that does not include only those elements recited, but may also include other elements such as those described in the instant specification. Unless otherwise explicitly stated, the use of the term "consisting" or "consisting of" or "consisting essentially of" is not intended to limit the scope of the invention to the enumerated elements named thereafter, unless otherwise indicated. Other combinations and/or modifications of the above-described elements, materials or structures used in the practice of the present invention may be varied or adapted by the skilled artisan to other designs without departing from the general principles of the invention.

The patents and articles mentioned above are hereby incorporated by reference herein, unless otherwise noted, to the extent that the same are not inconsistent with this disclosure.

The invention can be summarized by the following feature sets.

1. A system comprising at least one liquid 106, 206, 306, 406, 506, 606, 706 enclosed by a plurality of physical boundaries 102, 104, 114, 202, 204, 210, 302, 304, 312, 314, 320, 402, 404, 420, 436, 502, 504, 520, 602, 604, 620, 636, 644, 646, 702, 704, 710, 720 through which the liquid is impervious wherein at least one physical boundary 114, 210, 312, 314, 436, 436', 436", 536, 636, 646, 710 is moveable such to accommodate thermal expansion or contraction of the liquid caused by temperature variations over a given temperature range thereby preventing leaking, bursting, and the generation of bubbles, thus adapting the liquid containing chamber volume to the ambient temperature.
2. The system of feature set 1, where the liquid 106, 206, 306, 606, 706 is contained in a fluid-tight capsule 100, 200, 300, 600, 700 made of at least one rigid portion 102, 104, 202, 204, 302, 304, 602, 604, 620, 702, 704, 720 and at least one flexible portion 114, 210, 312, 314, 636, 646, 710.
3. The system of feature set 1, where the liquid 106, 206, 306, 606, 706 is contained in a fluid-tight capsule 100, 200, 300, 600, 700 made of at least 2 rigid portions 102, 104, 202, 204, 302, 304, 602, 604, 620, 702, 704, 720 tightly connected together by at least one flexible portion 114, 210, 312, 314, 636, 646, 710.
4. The system of feature set 3, where the at least one flexible portion 114, 210, 312, 314, 636, 646, 710 allows for a relative movement of the at least 2 rigid portions 102, 104, 202, 204, 302, 304, 602, 644, 702, 704 to modify the internal volume 118, 218, 318, 618, 718 of the fluidic capsule 100, 200,300, 600, 700.
5. The system of feature set 3, where the at least 2 rigid portions 102, 104, 202, 204, 602, 604, 620, 702, 720 are fixed and the at least one flexible portion 114, 210, 636, 646, 710 deforms to modify the internal volume 118, 218, 618, 718 of the fluidic capsule 100, 200, 600, 700.
6. The system of feature set 3, where the at least 2 rigid portions 102, 104, 202, 204, 602, 604, 620, 702, 720 can move relative to each other and the at least one flexible portion 114, 210, 636, 646, 710 deforms to modify the internal volume 118, 218, 618, 718 of the fluidic capsule 100, 200, 600, 700.
7. The system of feature set 1, where the liquid 206, 306 is contained in a fluid-tight capsule 200, 300 made of rigid portions 202, 204, 302, 304 with a low thermal expansion rate and at least one portion 210, 312, 314 with a high thermal expansion rate, so that the volumetric thermal expansion rate of the capsule 200, 300 is substantially identical, such as less than 10% different, preferably less than 5%, ideally less than 3% different from the volumetric thermal expansion rate of the liquid.
8. The system of feature set 1, where the liquid 406, 506 is contained in a fluid-tight capsule 400, 500 made of a first rigid chamber 408, 508 and a second rigid chamber 432, 532 in fluid communication with the first chamber through a capillary channel 434, 534, the second rigid chamber 432, 532 containing a gas 438, 538, the liquid and the gas being separated within the channel by a separating element 436, 436', 436", optionally the separating element selected from the list of separating elements consisting of second liquid 436, a gel 436' or a solid movable plug 436".
9. The system of feature set 8, where the liquid 506 and the gas 538 are separated within the channel 532 by a separating element, wherein the separating element is a rolling membrane 536.
10, The system of feature set 1, where the liquid 606 is contained in a fluid-tight capsule 600 made of a first rigid chamber 608 and a second semi-rigid chamber 632 in fluid communication with the first chamber through a capillary channel 634, the second chamber 632 being formed by at least one membrane 636, 646, the second chamber 632 containing the liquid 606.

11. A personal accessory comprising a system according to any of the preceeding feature sets.
12. A personal accessory according to feature set 11, where the capsule 100, 200, 300, 400, 500, 600, 700 has at least one transparent section 103 through which the user/wearer can see inside the capsule.
13. A personal accessory according to feature set 12, where the capsule 100, 200, 300, 400, 500, 600, 700 contains decorative elements 120 immersed in the liquid 106.
14. A personal accessory according to feature set 13, where at least one part of one of the decorative elements 120 immersed in the liquid 106, 206, 306, 406, 506, 606, 706 presents a light refraction index which is substantially identical to the liquid 106, 206, 306, 406, 506, 606, 706, such as less than 10% different, preferably less than 5%, ideally less than 3% different, so that said part of one of the decorative elements 120 is made invisible to an observer.
15. A personal accessory according to any of the preceeding feature sets, where the decorative elements 120 are actuated by gravity when the user/wearer changes the orientation of the fluidic capsule 100, 200, 300, 400, 500, 600, 700 relative to a gravitational force, by an acceleration provided by the movement of the user/wearer, or by a manual or automatic actuation mechanism.
16. A method for animating an accessory, the method comprising the steps of:
    a. fixing the accessory of feature set 1 on a wearer/user;
    b. moving the accessory with respect to the force of gravity; and
    c. observing the animation effect.

Other characteristics and modes of execution of the invention are described in the appended claims.

Materials used for the realization of the present invention are chosen to be suitable and in compliance to the operating temperature range of the invention. Such materials are e.g. metals, polymers or glass, and in particular sapphire glass. The same goes for structures used for the realization of the present invention, such as e.g. bellows, chips, or intrinsic membranes, are configured to be suitable and in compliance to the operating temperature range of the invention.

Further, the invention should be considered as comprising all possible combinations of every feature described in the instant specification, appended claims, and/or drawing figures that may be considered new, inventive and industrially applicable.

Additional features and functionality of the invention are described in the claims appended hereto and/or in the abstract. Such claims and/or abstract are hereby incorporated in their entirety by reference thereto in this specification and should be considered as part of the application as filed.

Multiple variations and modifications are possible in the embodiments of the invention described here. Although certain illustrative embodiments of the invention have been shown and described here, a wide range of changes, modifications, and substitutions is contemplated in the foregoing disclosure. While the above description contains many specific details, these should not be construed as limitations on the scope of the invention, but rather exemplify one or another preferred embodiment thereof. In some instances, some features of the present invention may be employed without a corresponding use of the other features. Accordingly, it is appropriate that the foregoing description be construed broadly and understood as being illustrative only, the spirit and scope of the invention being limited only by the claims that ultimately issue in this application.

What is claimed is:

1. A personal accessory comprising a capsule having an internal volume and at least one transparent section, the at least one transparent section adapted so that at least a portion of the internal volume of the capsule is visible therethrough, the capsule containing at least one liquid, the capsule containing at least one decorative element immersed in the at least one liquid, wherein at least one part of the at least one decorative element immersed in the at least one liquid has a light refraction index, which is substantially identical to the at least one liquid, less than 10% different from the at least one liquid, so that said at least one part of the at least one decorative element is made essentially invisible to an observer regardless of the capsule orientation with respect to gravity, the at least one liquid enclosed in a volume of the capsule defined by a plurality of physical boundaries which are liquid-tight, wherein at least one of the plurality of physical boundaries is moveable so as to accommodate thermal expansion or contraction of the at least one liquid caused by temperature variations over a given temperature range thereby preventing leaking, bursting, and generation of bubbles, thus adapting the internal volume of the capsule containing the at least one liquid to the ambient temperature, wherein the capsule is made of at least two rigid physical boundaries tightly connected by at least one flexible physical boundary.

2. The personal accessory of claim 1, wherein at least one physical boundary of the capsule is made of at least one rigid portion and at least one flexible portion.

3. The personal accessory of claim 1, wherein the at least one flexible physical boundary allows for a relative movement of the at least two rigid physical boundaries to modify the internal volume of the capsule.

4. The personal accessory of claim 1, wherein the at least two rigid physical boundaries are fixed and the at least one flexible physical boundary deforms to modify the internal volume of a fluidic capsule.

5. The personal accessory of claim 1, wherein the at least two rigid physical boundaries can move relative to each other and the at least one flexible physical boundary deforms to modify the internal volume of the capsule.

6. The personal accessory of claim 1, wherein the at least one liquid is contained in the capsule, the capsule being made of rigid portions with a low thermal expansion rate and at least one portion with a high thermal expansion rate, so that a volumetric thermal expansion rate of the capsule is substantially identical, such as less than 10% different from the volumetric thermal expansion rate of the at least one liquid.

7. The personal accessory of claim 1, wherein the at least one liquid is contained in the capsule, the capsule comprising a first rigid chamber and a second rigid chamber in fluid communication with the first rigid chamber through a channel, the second rigid chamber containing a gas, the at least one liquid and the gas being separated within the channel by a separating physical boundary, the separating physical boundary consisting of a gel, a solid movable plug and a meniscus of a second liquid.

8. The personal accessory of claim 7, wherein the at least one liquid and the gas are separated within the channel by a separating physical boundary, wherein the separating physical boundary is a rolling membrane.

9. The personal accessory according to claim 1, wherein the at least one liquid is contained in the capsule, the capsule comprising a first rigid chamber and a second semi-rigid chamber in fluid communication with the first rigid chamber through a capillary channel, the second semi-rigid chamber being formed by at least one membrane, the second chamber containing the at least one liquid.

10. A personal accessory according to claim 1, wherein the at least one decorative element is actuated by gravity when a user/wearer changes the orientation of the capsule relative to a gravitational force, by an acceleration provided by a movement of the user/wearer, or by a manual or automatic actuation mechanism.

11. A method for animating an accessory, the method comprising the steps of:

a. fixing the accessory of claim 1 on a wearer/user;

b. moving the accessory with respect to the force of gravity; and c. observing an animation effect.

* * * * *